US005335571A

United States Patent [19]

Pike

[11] Patent Number: 5,335,571

[45] Date of Patent: Aug. 9, 1994

[54] PRODUCT LENGTH CONTROL SYSTEM

[75] Inventor: Gayle B. Pike, Twin Falls, Id.

[73] Assignee: J. R. Simplot Company, Boise, Id.

[21] Appl. No.: 29,560

[22] Filed: Mar. 11, 1993

[51] Int. Cl.[5] ..... B26D 1/09; B26D 7/06

[52] U.S. Cl. ..... 83/13; 83/73; 83/359; 83/364; 83/370; 83/732; 83/932

[58] Field of Search ..... 83/370, 732, 932, 364, 83/75.5, 360, 363, 369, 13, 371, 25, 108, 359, 358, 73; 198/370, 372; 99/643

[56] References Cited

U.S. PATENT DOCUMENTS

| | | | |
|---|---|---|---|
| 1,102,808 | 7/1914 | Shoman | 83/732 |
| 3,291,173 | 12/1966 | Smith et al. | 99/636 |
| 3,349,905 | 10/1957 | Crawford | 209/82 |
| 3,669,263 | 6/1972 | Babb | 209/82 |
| 3,721,145 | 3/1973 | Lazzarini | 83/732 |
| 3,732,761 | 5/1973 | Sanders | 83/73 X |
| 3,738,258 | 6/1973 | Goodale | 83/732 X |
| 3,796,146 | 3/1974 | Lacey | 83/364 |
| 3,944,077 | 3/1976 | Green | 209/73 |
| 4,023,605 | 5/1977 | Hellström et al. | 83/732 X |
| 4,576,071 | 3/1986 | Rayment | 83/371 X |
| 5,142,955 | 9/1992 | Hale | 83/370 X |
| 5,163,865 | 11/1992 | Smith | 83/371 X |

*Primary Examiner*—Seidel Richard K.
*Assistant Examiner*—Kenneth E. Peterson
*Attorney, Agent, or Firm*—Kelly Bauersfeld & Lowry

[57] ABSTRACT

A system and method are provided for cutting oversized vegetable products or the like, such as potatoes in the course of producing french fry strips, to obtain a controlled product length distribution. The system includes a conveyor for transporting the products in single file to a length sensor station for detecting the length of each product, and then to a cutting station for cutting each overlong product at one of a plurality of different positions as a function of the detected product length. Such length-responsive cutting provides significant control over the distribution of product lengths, while minimizing or eliminating the presence of products which are too long or short.

14 Claims, 3 Drawing Sheets

PRODUCT LENGTH CONTROL SYSTEM

BACKGROUND OF THE INVENTION

This invention relates generally to process systems and methods for controlling the size of vegetable products or the like, particularly such as potatoes in the course of french fry strip production. More specifically, the present invention relates to a cutting system and method for cutting overlong raw or whole products in response to detected product length, to control finished product length distribution while minimizing or eliminating the presence of products which are too long or short.

Production equipment for processing and packaging elongated articles such as vegetable products or the like are generally known in the art. As one example, it is well-known to process potatoes through a sequence of peeling, cutting and parfrying steps to produce elongated french fry potato strips which are typically packaged in a frozen state. Natural variations in the length of the raw potato product, prior to strip cutting, yields a corresponding distribution of cut french fry strip lengths. Accordingly, some variation in the lengths of the product strips supplied to the consumer is expected and is perceived by the consumer as a desirable characteristic.

However, products of excessive length can contribute to production problems and/or negatively impact the consumer's perception of the finished product. In particular, with regard to production of french fry potato strips, so-called hydraulic or water knives of the type described in U.S. Pat. Nos. 2,108,625 and 4,372,184 are commonly used to cut raw whole potatoes into elongated french fry strips of selected cross sectional shape and size. In cutting equipment of this type, potatoes having excessive lengths can become lodged within the cutting knives and thereby interrupt the cutting process. Alternately, the cut surfaces on strips of excessive length can deteriorate to result in fragile and/or fractured strips which tend to break apart into small pieces upon subsequent process steps. The presence of a high proportion of extremely short strip pieces is perceived negatively by the consumer, suggesting that the french fry strips have been cut from small potatoes. Moreover, french fry strips of excessive length which do not break apart in the course of post-cutting processing unfortunately exhibit a tendency to bend or curl during parfrying and/or freezing, once again resulting in undesirable appearance characteristics in the finished product.

In the past, the above-referenced issues of product length distribution have been addressed in different ways. In a typical french fry production line, raw potatoes are commonly graded according to size to remove products of excessive length from the production line flow. In addition, size grading normally entails removal of a high percentage of relatively small potatoes, such that post-cutting breakage of longer strips does not result in an undesirably high proportion of short strip pieces. Alternatively, cutting systems have been proposed for cutting overlong products generally at a midpoint or at a fixed distance from one end of the product as described, for example in U.S. Pat. Nos. 3,291,173; 3,721,145; and 3,944,077. While such cutting systems beneficially reduce the occurrence of cut strips having excess length, the cutting techniques have not satisfactorily reduced the occurrence of an undesirable proportion of short potato strip pieces.

The present invention overcomes the problems and disadvantages encountered in prior art production systems, by providing an improved cutter system and method for variably cutting overlong products as a function of actual product length, thereby obtaining significant control over the length distribution of the finished product.

SUMMARY OF THE INVENTION

In accordance with the invention, a product length control system and method are provided for controlling the length distribution of processed vegetable products or the like, particularly such as french fry potato strips. The system includes means for detecting the length of each overlong product, and for responding to the detected length to cut such product at a selected one of several different positions. Length-responsive cutting of the overlong products provides a significant degree of control over the length distribution of the finished product, while substantially minimizing or eliminating the presence of cut products which are undesirably long or short.

In accordance with a preferred form of the invention, the products to be processed are supplied to a conveyor for passage in single file in succession to a length sensor station and a cutting station. The conveyor includes a succession of open pockets or shoes for receiving a single product therein, with one end of each product riding against a reference base wall. The sensor station includes a plurality of detector elements disposed at preset different distances from the base wall. Each product of overlong dimension contacts one or more of the detector elements, in accordance with actual product length, as said product is conveyed through the sensor station.

The detector elements appropriately signal a system controller which in turn actuates one of a plurality of cutter knives at the cutting station, wherein the cutter knives are mounted at preset different distances from the reference base wall. Overlong products are thus cut at a position responsive to actual detected product length. From the cutting station, the products are returned to production line flow.

Overlong potatoes may be provided to the control system conveyor by manual selection from production line flow, or in response to separation of overlong products by means of other length grading and separation equipment. Alternatively, the entire production line flow including short to long products may be supplied to one or more control system conveyors, with product cutting being limited to those products detected to have a length beyond a predetermined threshold. Moreover, the actual lengths of the cut products can be monitored by product length monitoring equipment to provide a feedback input to the system controller.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION THE PREFERRED EMBODIMENTS

Figure 1:
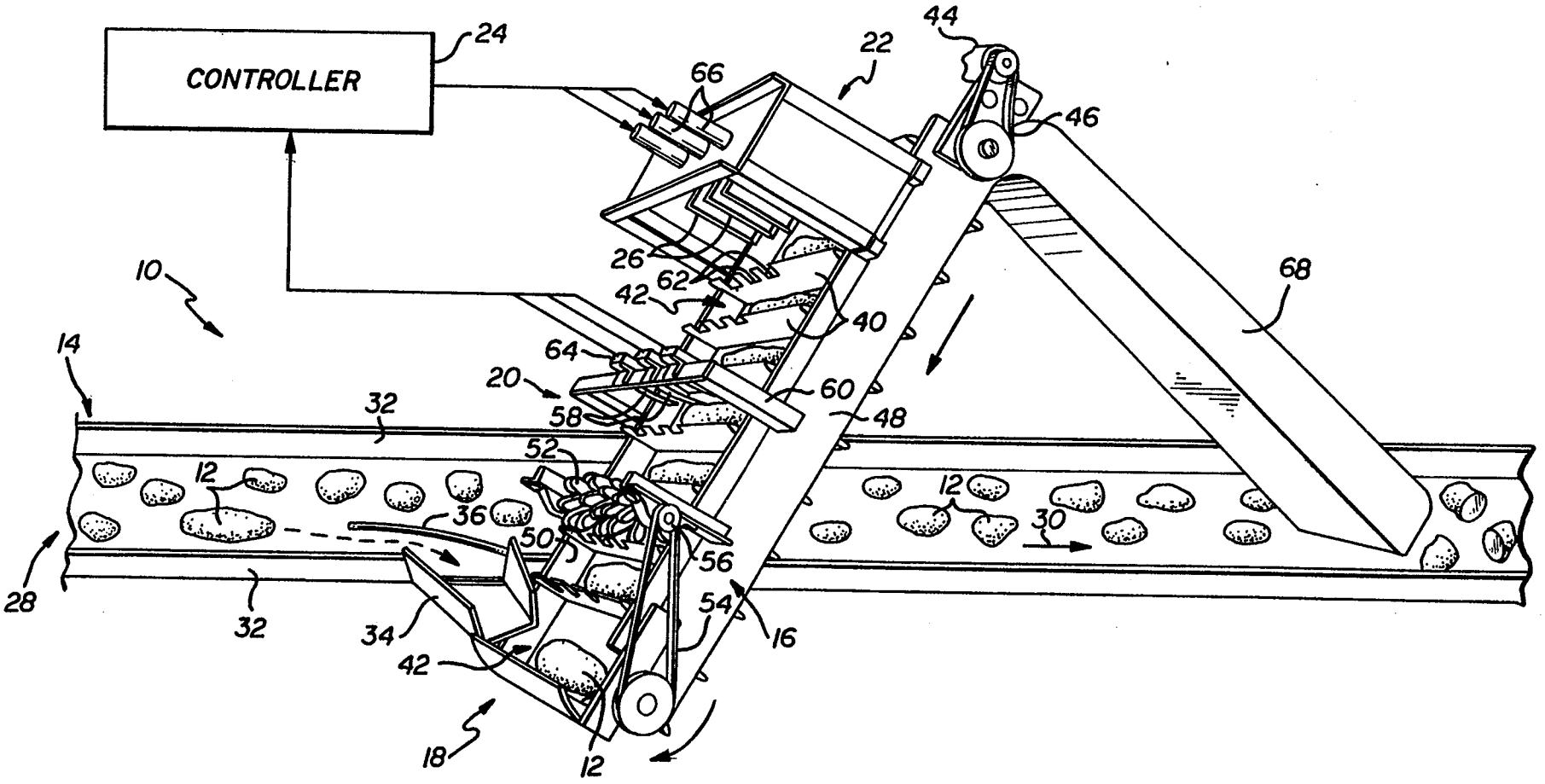
FIG. 1 is a perspective view, shown in somewhat diagrammatic form, illustrating components of a product length control system embodying the novel features of the invention.
Figure 2:
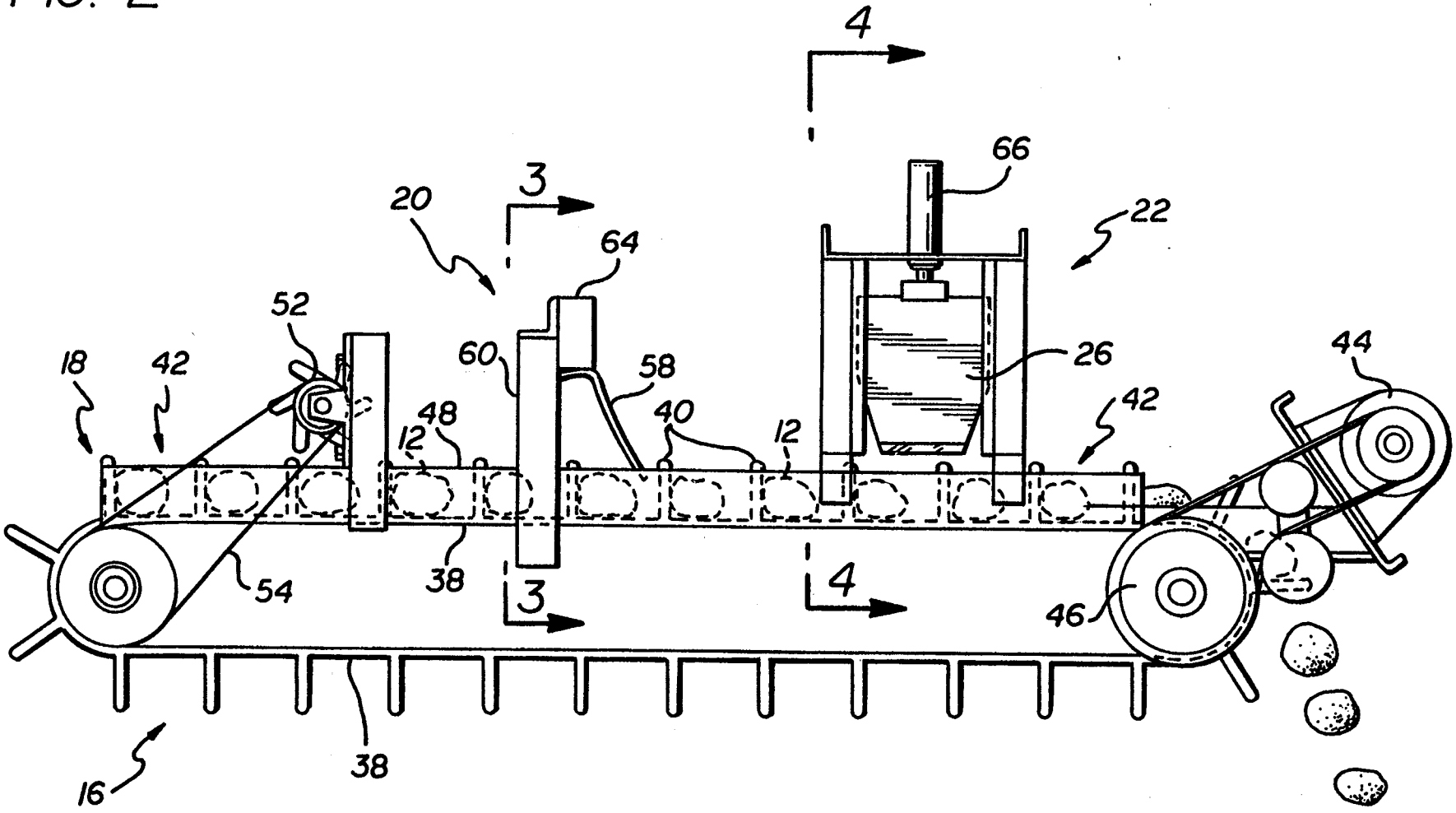
FIG. 2 is an enlarged side elevational view depicting a control system conveyor for use in length-responsive cutting of overlong products.

As shown in the exemplary drawings, a control system referred to generally by the reference numeral 10 in FIGS. 1 and 2 is provided for cutting overlong vegetable products such as whole potatoes 12 in accordance with detected product length. The control system thus minimizes or eliminates products of excessive length in a production environment. In addition, length-responsive cutting of the overlong products provides a substantial degree of control over product length distribution.

The product length control system 10 of the present invention is particularly suited to a french fry strip production line wherein raw whole potatoes are cut into french fry strips followed typically by appropriate cooking, parfrying and freezing steps. The system 10 substantially eliminates overlong potatoes from a production line flow 14, thereby substantially eliminating french fry strips of excessive length. In this regard, it is known that french fry strips of excessive length often exhibit cut surfaces of inferior quality and frequently break during post-cutting processing, to result in an undesirable proportion of short potato strip pieces in the finished product. The present invention effectively eliminates these problems encountered with overlong potato strips, and thus also reduces the proportion of relatively short strips or pieces in the finished product. As a result, the production line flow 14 may include an increased proportion of relatively smaller potatoes 12, without creating an unacceptable proportion of short potato strips. Although the invention is shown and described herein with respect to production processing of potatoes 12 to form, for example, french fry strips, it will be understood that the product length control system may be used with other types of elongated products such as vegetable products or the like wherein cut product length distribution control is a desired feature.

In general terms, the system 10 comprises a cutting convey or 16 having an input end 18 for receiving potatoes 12 from the production line flow 14. The potatoes 12 are transported by the conveyor 16 in single file, and in a predetermined orientation, through a length sensor station 20 and a cutting station 22. The length of each potato in succession is detected at the sensor station 20, and a system controller 24 is appropriately signaled to operate one of a plurality of cutting knives 26 at the cutting station 22. The cutting knives are provided to sever each detected overlong potato 12 at a selected one of several different cutting locations, in accordance with detected potato length, thereby splitting the potato into two shorter pieces of known length. With this arrangement, overlong potatoes can be substantially eliminated from the production line flow 14, and the length distribution of the resultant finished product can be regulated according to cutting knife actuation as a function of detected product length.

FIG. 1 shows the production line flow 14 in the form of a plurality of individual potatoes 12 transported along a line conveyor 28. The cutting conveyor 16 of the control system 10 is installed alongside the line conveyor 28 in a convenient position for relatively simple manual diversion of relatively long and potentially overlong potatoes 12 from the line conveyor 28 to the cutting conveyor 16. In a typical french fry production environment, diversion of potentially overlong products may be done manually as part of conventional post-peeling or pre-cutting visual inspection of raw whole potatoes. In this regard, in a typical production inspection environment, several cutting conveyors 16 are desirably installed at spaced intervals along the length of the line conveyor 28 to ensure diversion of virtually all overlong potatoes for length-responsive cutting in accordance with the present invention. Alternatively, it will be understood that one or more cutting conveyors 16 in accordance with the present invention may be adapted to receive the entire production line flow 14, wherein this line flow 14 may include potatoes 12 which have been previously size graded to insure a high proportion of potentially overlong products.

FIG. 1 shows the line conveyor 28 to include a longitudinally moving belt 30 carrying the line flow 14 between a pair of short upstanding side walls 32. One of the side walls 32 is interrupted by a laterally directed diverter chute 34 through which potatoes 12 can be guided to fall onto the input end 18 of the cutting conveyor 16. A curved guide rod 36 is conveniently provided at a downstream margin of the chute 34 and protrudes in an upstream direction a short distance into the product line flow 14 to assist in guiding selected, potentially overlong potatoes 12 to the cutting conveyor 16 via the diverter chute 34. The guide rod 36 is positioned and oriented such that the potatoes can slip over the guide rod 36 in the event that the chute 34 becomes full, whereby the potatoes skipping over the guide rod can travel down the line flow to a subsequent cutting conveyor (not shown).

The cutting conveyor 16 generally comprises an incline or ramped configuration having a drive belt 38 equipped with a succession of upstanding, transversely extending cleats 40 to define a succession of upwardly open potato-receiving shoes or pockets 42. A drive motor 44 operates a pulley arrangement 46 to displace the drive belt 38 in an upward direction between a pair of upstanding side walls 48 and 50. The inclination angle of the cutting conveyor 16 may vary, with an angle of about 60 degrees being preferred.

The overall size and shape of each potato-receiving pocket 42 is selected to receive a single potato 12 therein in a predetermined orientation. In this regard, the pockets 42 have a generally rectangular shape to accommodate receipt of a single potato in an orientation extending transversely to the path of conveyor motion. A singulation roller 52 is mounted over the drive belt 38 and cleats 40 near the conveyor input end 18, and is rotatably driven by a belt 54 and pulley 56 to prevent upward conveyance of two or more potatoes within a single conveyor pocket 42. The singulation roller 52 comprises, in the preferred form, a relatively soft cylindrical roller structure with a large plurality of outwardly radiating flexible fingers designed to lift excess potatoes from each pocket 42, such that the lifted potato or potatoes fall down the ramped conveyor for deposit within a succeeding empty pocket 42 located therebelow. Importantly, the conveyor drive speed is selected to accommodate a normal oversized potato input in a typical production line environment.

Figure 4:
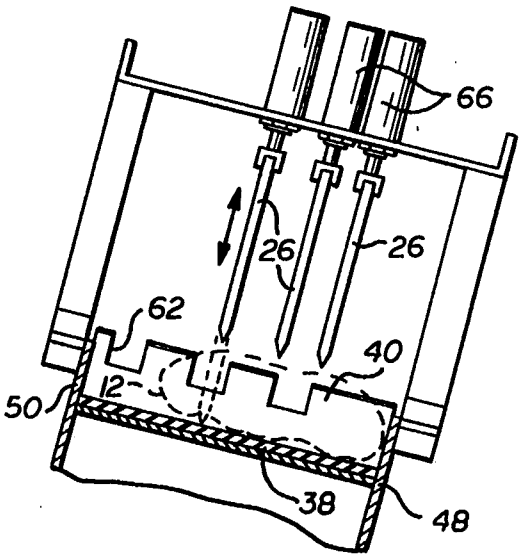
FIG. 4 is an enlarged fragmented transverse sectional view taken generally on the line 4—4 of FIG. 2.
Figure 3:
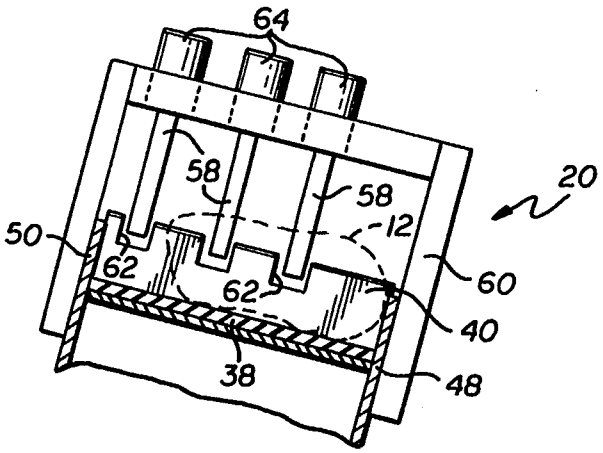
FIG. 3 is an enlarged fragmented transverse sectional view taken generally on the line 3—3 of FIG. 2.

The drive conveyor 16 is tilted in a lateral cross sectional plane, as shown best in FIGS. 3 and 4. That is, the conveyor 16 is tilted to right as viewed in FIGS. 3 and 4 at an angle of about 15 to 25 degrees, whereby each potato 12 oriented lengthwise within each pocket 42 slides by gravity across the conveyor belt 38, until one end of the potato contacts the side wall 48. Thus, the side wall 48 of the cutting conveyor 16 comprises a reference or base wall utilized to facilitate subsequent product length detection and cutting, as will be described.

The length sensor station 20 comprises a plurality of pivotally mounted detector elements or fingers 58 mounted on a bridge structure 60 over the potatoes 12 transported along the conveyor 16. As shown in FIG. 3, the detector elements 58 are mounted at predetermined different distances from the reference base wall 48, with the illustrative drawings showing a plurality of three detector elements 58 mounted, for example, at distances of six inches, eight inches, and nine inches respectively, from the reference base wall 48. If desired or necessary, appropriate notches 62 may be formed in the upstanding conveyor cleats 40 to prevent tripping of the detector elements 58 by said cleats.

Each of the detector elements 58 is associated with an appropriate mechanical or other suitable switch 64 providing an output signal when the detector element is tripped. In this regard, each overlong potato 12 will trip one or more of the detector elements 58, in accordance with the actual potato length. For example, an overlong potato product having a length greater than six inches but less than eight inches will trip the first detector element 58. By contrast, a potato product having a length greater than eight inches but less than nine inches will trip the first two detector elements. Similarly, a potato product having a length greater than nine inches will trip all three detector elements 58, whereas a potato having a length less than six inches will not trip any of the detector elements.

The detector switches 64 are coupled to the system controller 24 and thus provide length-indicative input signals to the controller. The system controller in turn operates pneumatic actuators 66 or the like associated individually with the plurality of cutting knives 26 at the cutting station 22, as shown in FIG. 4. These cutting knives are also mounted at predetermined different distances from the reference base wall 48. A selected one of the cutting knives 26 is actuated to cut each overlong product in accordance with the detected product length, thereby severing the product into two shorter pieces. With the detector arrangement as previously described, in one preferred form of the invention. Three cutting knives 26 are respectively provided at distances of 3.5 inches, 4 inches, and 5 inches from the reference base wall 48. In typical operation, an overlong product having a length greater than a minimum threshold of about six inches but less than eight inches would be cut using the first cutting knife at the 3.5 inch position, and so forth. In this manner, overlong products are substantially eliminated from the production line flow, whereas product length distribution in a typically preferred median range of approximately three to four inches is maximized.

From the cutting station 22, the potato products travel to the upper end of the cutting conveyor 16 for return to the product line flow 14 via a slide return chute 68.

Figure 5:
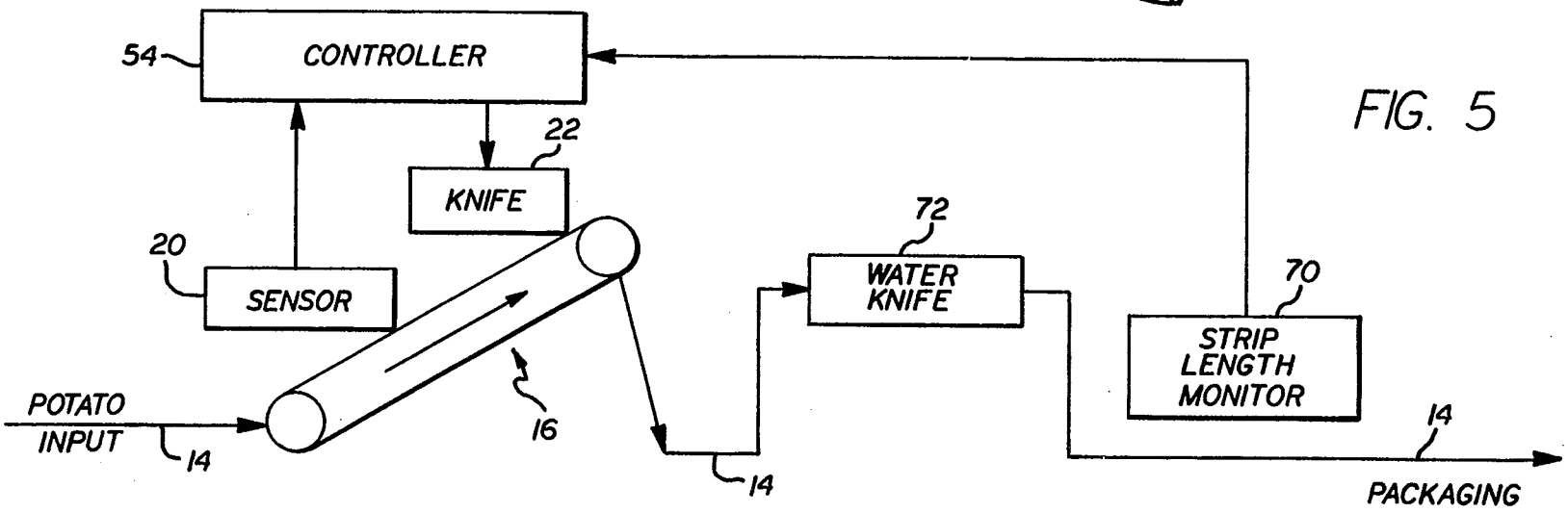
FIG. 5 is a schematic diagram illustrating an alternative form of the invention.

FIG. 5 illustrates an alternative form of the invention, wherein the system controller 24 may receive feedback length information from a strip length monitor 70, which may be constructed in accordance with U.S. Pat. Nos. 3,349,905 and 3,669,263, which are incorporated by reference herein. The strip length monitor 70 may be positioned along the production line flow 14 downstream of a water knife 72 of the type described, for example, in U.S. Pat. Nos. 3,108,625 and 4,372,184, which are incorporated by reference herein. The strip length monitor 70 utilizes optical components to detect the actual cut strip length and thereby provide actual cut distribution information to the system controller 24. The system controller 24 may respond automatically to this strip length input data to alter its response in connection with potato length detection at the detector station 20 and corresponding knife actuation at the cutting station 22 to vary the final strip length distribution in a known manner. For example, the cutting knives at the cutting station 22 may be actuated in response to detected potato length information to increase or decrease the distribution of relatively longer cut strips, in accordance with desired or customer specifications.

The product length control system of the present invention thus provides apparatus and method for substantially eliminating products of excess length from a production line flow, thereby eliminating problems associated with overlong products. Products having excess lengths are detected and cut in one of several positions as a function of actual detected length, in a manner which also minimizes the undesirable inclusion of short strip pieces. In the case of a production line for cutting French fry potato strips, the present invention provides an effective system and method for strip length distribution control without requiring sorting or special handling of the multitude of finished cut strips.

A variety of further modifications and improvements to the cutting system and method of the present invention will be apparent to those skilled in the art. For example, the mechanically pivoted detector elements 58 may be substituated by alternative length sensor devices, such as optical components or the like capable of providing the desired product length measurement. Accordingly, no limitation on the invention is intended by way of the foregoing description and accompanying drawings, except as set forth in the appended claims.

What is claimed is:

1. A length control system for cutting oversized vegetable products, said length control system comprising:

conveyor means for conveying the products along a predetermined path, said conveyor means including a succession of upwardly open pockets each having a size and shape for receiving a single product therein oriented to extend generally transversely with respect to said predetermined path;

said conveyor means including a reference base wall extending along one side of said open pockets, and means for positioning said products within said pockets with one end of each of said products engaging said reference base wall, said positioning means comprising means for supporting said pockets in a laterally tilted position whereby said products slide by gravity within said pockets to contact said reference base wall;

length sensor means for detecting the length of each one of the products conveyed along said predetermined path; and cutting means responsive to said length sensor means for cutting each one of the products having a length greater than a selected threshold at one of a plurality of different positions in accordance with actual product length.

2. The length control system of claim 1 wherein said conveyor means includes means for conveying the products in single file and in predetermined orientation.

3. The length control system of claim 1 wherein said conveyor means includes an input end for receiving said products, said conveyor means being inclined from said input end.

4. The length control system of claim 3 wherein said conveyor means is inclined at an angle of about sixty degrees.

5. The length control system of claim 1 wherein said cutting means comprises a plurality of cutting knives and means for individually actuating said cutting knives to cut said products at different positions along the lengths thereof.

6. The length control system of claim 1 wherein said pockets are laterally tilted at an angle of about 15–25 degrees.

7. The length control system of claim 1 wherein said cutting means comprises a plurality of cutting knives mounted at different distances from said reference base wall, and means for individually actuating said cutting knives to cut said products at different positions along the lengths thereof.

8. A length control system for controlling product length distribution in a cutting system having strip cutter means for cutting products into elongated strips, said length control system comprising:

a conveyor for conveying the products in single file along a predetermined path in a predetermined orientation;

a length sensor station mounted along said conveyor and including means for detecting the length of each one of the products having a length greater than a selected threshold and for generating a signal representative of actual product length;

a cutting station mounted along said conveyor at a position downstream from said length sensor station and including a plurality of cutting knives and knife actuator means for separately actuating said knives to cut said products at one of a plurality of different positions along the product length;

means for supplying the products from said cutting station to the strip cutter means;

means for monitoring the length distribution of product strips discharged from said strip cutter means and for generating signals representative thereof; and controller means responsive to said actual product length signals from said length sensor means and further responsive to said product strip length distribution signals from said monitoring means, for actuating said cutting knives to cut each of the products having a length greater than said threshold at a position functionally related to actual product length and actual product strip length distribution.

9. A length control system for cutting oversized products, said length control system comprising:

a conveyor for conveying the products in single file along a predetermined path in a predetermined orientation;

a length sensor station mounted along said conveyor and including means for detecting the length of each one of the products having a length greater than a selected threshold and for generating a signal representative of actual product length;

a cutting station mounted along said conveyor at a position downstream from said length sensor station and including a plurality of cutting knives and knife actuator means for separately actuating said knives to cut said products at one of a plurality of different positions along the product length; and controller means responsive to said actual product length signals from said length sensor station for actuating said cutting knives to cut each of the products having a length greater than said threshold at a position functionally related to actual product length;

said conveyor including an input end, a diverter chute for diverting selected products from a production line flow to said conveyor input end, and a return chute for returning products from said cutting station to the production line flow.

10. The length control system of claim 9 wherein said diverter chute includes a curved guide rod protruding in an upstream direction into the production line flow.

11. A length control system for cutting oversized products, said length control system comprising:

a conveyor for conveying the products in single file along a predetermined path in a predetermined orientation, said conveyor means including a succession of upwardly open pockets each having a size and shape for receiving a single product therein oriented to extend generally transversely with respect to said predetermined path;

said conveyor means including a reference base wall extending along one side of said open pockets, and means for positioning said products within said pockets with one end of each of said products engaging said reference base wall, said positioning means comprising means for supporting said pockets in a laterally tilted position whereby said products slide by gravity within said pockets to contact said reference base wall;

a length sensor station mounted along said conveyor and including means for detecting the length of each one of the products having a length greater than a selected threshold and for generating a signal representative of actual product length;

a cutting station mounted along said conveyor at a position downstream from said length sensor station and including a plurality of cutting knives and knife actuator means for separately actuating said knives to cut said products at one of a plurality of different positions along the product length; and controller means responsive to said actual product length signals from said length sensor station for actuating said cutting knives to cut each of the products having a length greater than said threshold at a position functionally related to actual product length.

12. A method of cutting oversized products products to control product length distribution, said method comprising the steps of:

conveying the products along a predetermined laterally tilted path in single file and in a predetermined orientation to extend generally transversely with respect to said predetermined path with one end of each product contacting a reference base wall;

detecting the length of each one of the products; and cutting each product having a length greater than a selected threshold at one of a plurality of different positions in response to detected product length.

13. The method of claim 12 wherein said conveying step includes conveying the products along a longitudinally inclined path.

14. The method of claim 12 further including the step of diverting selected and potentially overlong products from a production line flow to said conveying step for conveyance along said predetermined path.

* * * * *